US007878446B2

(12) United States Patent
Reinsel et al.

(10) Patent No.: US 7,878,446 B2
(45) Date of Patent: Feb. 1, 2011

(54) DISPENSER HOUSING WITH MOTORIZED ROLLER TRANSPORT

(75) Inventors: Christopher M. Reinsel, Neenah, WI (US); David J. Gennrich, Middleton, WI (US); Kent J. Kallsen, Jefferson, WI (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 1062 days.

(21) Appl. No.: 11/551,694

(22) Filed: Oct. 20, 2006

(65) Prior Publication Data

US 2008/0105780 A1 May 8, 2008

(51) Int. Cl.
*B65H 51/04* (2006.01)

(52) U.S. Cl. ..... 242/564.4; 242/595

(58) Field of Classification Search ..... 242/579, 242/580, 563, 564, 564.1, 564.4, 595, 596.8, 242/906, 565, 566; 312/34.8, 34.22; 83/205, 83/614, 649, 650; 225/15, 19, 23, 39, 42, 225/46, 47, 106

See application file for complete search history.

(56) References Cited

U.S. PATENT DOCUMENTS

| | | | |
|---|---|---|---|
| 2,193,759 | A | 3/1940 | Birr |
| 2,839,345 | A | 6/1958 | Engel et al. |
| 2,859,814 | A | 11/1958 | Berney |
| 2,930,663 | A | 3/1960 | Weiss |
| 3,007,650 | A | 11/1961 | Burton |
| 3,269,592 | A | 8/1966 | Slye et al. |
| 3,288,387 | A | 11/1966 | Craven, Jr. |
| 3,384,280 | A | 5/1968 | Summersby |

(Continued)

FOREIGN PATENT DOCUMENTS

| | | | |
|---|---|---|---|
| DE | 3342921 | A1 | 6/1985 |

(Continued)

OTHER PUBLICATIONS

International Preliminary Report on Patentability of PCT/US2007/081381, dated Apr. 30, 2009.

(Continued)

*Primary Examiner*—William A Rivera
(74) *Attorney, Agent, or Firm*—Joel T. Charlton

(57) ABSTRACT

An electrically powered dispenser for paper towels uses a special roller bracket to provide not only proper positioning and support for the drive and pinch roller shafts, but also tension and grounding between the drive and pinch rollers, thereby producing a dispenser that is both reliable to operate and simple to assemble. The mounting bracket is integrally formed from a single sheet of conductive material and preferably includes a pair of side plates connected by a mounting bar which includes an integrally formed tear bar portion for cutting the material after it has been transported past the rollers. Each side plate incorporates a flexible bridge (arm) portion for biasing each of the two shafts against a respective bearing portion to thereby complete a static discharge path from the rollers to the mounting bar without requiring any separate springs, contacts or wires. In a preferred embodiment, a door mounted projection blade assists in proper paper loading, a removable top cover functions as a universal mounting bracket, and flexible paper protection fingers discourage unwanted contact between the paper and the tear bar.

18 Claims, 10 Drawing Sheets

U.S. PATENT DOCUMENTS 3,573,783 A 4/1971 Fudaley
3,628,743 A 12/1971 Bastian
3,635,417 A 1/1972 Kajiwara et al.
3,636,408 A 1/1972 Shuman
3,730,409 A 5/1973 Ratti
3,743,865 A 7/1973 Riechmann
3,836,828 A 9/1974 Siegel
3,850,356 A 11/1974 Abe et al.
3,858,951 A 1/1975 Rasmussen
3,917,191 A 11/1975 Graham, Jr. et al.
4,099,118 A 7/1978 Franklin et al.
4,106,684 A 8/1978 Hartbauer et al.
4,148,442 A 4/1979 Baumann et al.
4,159,807 A 7/1979 Honsel et al.
4,165,138 A 8/1979 Hedge et al.
4,267,752 A 5/1981 Byrt et al.
4,358,169 A 11/1982 Filipowicz et al.
4,378,912 A 4/1983 Perrin et al.
4,464,622 A 8/1984 Franklin
4,552,315 A 11/1985 Granger
4,569,467 A 2/1986 Kaminstein
4,605,988 A 8/1986 Nienhuis et al.
4,611,768 A 9/1986 Voss et al.
4,666,099 A 5/1987 Hoffman et al.
4,712,461 A 12/1987 Rasmussen
4,721,265 A 1/1988 Hawkins
4,738,176 A 4/1988 Cassia
4,741,340 A 5/1988 Batina et al.
4,756,485 A 7/1988 Bastian et al.
4,760,492 A 7/1988 Walsh
4,786,005 A 11/1988 Hoffman et al.
4,790,490 A 12/1988 Chakravorty
4,796,825 A 1/1989 Hawkins
4,807,824 A 2/1989 Gains et al.
4,823,663 A 4/1989 Hamlin
4,826,262 A 5/1989 Hartman et al.
4,831,488 A 5/1989 Playe
4,846,412 A 7/1989 Morand
4,960,248 A * 10/1990 Bauer et al. ..... 242/564.4
4,992,907 A 2/1991 Shreeve et al.
5,031,258 A 7/1991 Shaw
5,107,734 A * 4/1992 Armbruster ..... 83/205
5,148,126 A 9/1992 Spencer
5,205,454 A 4/1993 Schutz et al.
5,217,035 A 6/1993 Van Marcke
5,235,882 A 8/1993 Rabourn
5,244,161 A 9/1993 Wirtz-Odenthal
5,257,711 A 11/1993 Wirtz-Odenthal
5,271,574 A 12/1993 Formon et al.
5,294,192 A 3/1994 Omdoll et al.
5,299,407 A 4/1994 Schuttler et al.
5,302,167 A 4/1994 Kley et al.
5,335,811 A 8/1994 Morand
5,365,783 A 11/1994 Zweifel
5,400,982 A 3/1995 Collins
5,452,832 A 9/1995 Niada
5,505,129 A 4/1996 Greb et al.
5,511,743 A 4/1996 Kozlowsky et al.
5,526,973 A 6/1996 Boone et al.
5,538,587 A 7/1996 Sakano et al.
5,553,522 A 9/1996 Boldrini et al.
5,558,302 A 9/1996 Jesperson
5,604,992 A 2/1997 Robinson
5,625,327 A 4/1997 Carroll et al.
5,630,526 A 5/1997 Moody
5,670,886 A 9/1997 Wolff et al.
5,682,032 A 10/1997 Philipp
5,694,653 A 12/1997 Harald
5,704,566 A 1/1998 Schutz et al.
5,730,165 A 3/1998 Philipp
5,772,291 A 6/1998 Byrd et al.
5,806,203 A 9/1998 Robinson
5,823,083 A 10/1998 Obertegger et al.
5,833,413 A 11/1998 Cornelius
5,846,003 A 12/1998 Mori et al.
5,860,344 A 1/1999 Yamamoto et al.
5,868,343 A 2/1999 Granger
5,899,406 A 5/1999 Payne
5,915,645 A 6/1999 Granger
5,950,898 A 9/1999 Menna
5,974,764 A 11/1999 Anstey et al.
5,979,822 A 11/1999 Morand et al.
5,986,549 A 11/1999 Teodorescu
6,032,898 A 3/2000 LaCount et al.
6,067,673 A 5/2000 Paese et al.
6,069,354 A 5/2000 Alfano et al.
6,105,898 A 8/2000 Byrd et al.
6,118,469 A 9/2000 Hosomi
6,145,779 A 11/2000 Johnson et al.
6,152,397 A 11/2000 Purcell
6,198,271 B1 3/2001 Heger et al.
6,279,777 B1 8/2001 Goodin et al.
6,293,486 B1 9/2001 Byrd et al.
6,297,627 B1 10/2001 Towne et al.
6,354,533 B1 3/2002 Jespersen
6,363,824 B1 4/2002 Granger
6,412,655 B1 7/2002 Stuetzel et al.
6,412,679 B2 7/2002 Formon et al.
6,419,136 B2 7/2002 Formon et al.
6,486,680 B1 11/2002 Mull
6,592,067 B2 7/2003 Denen et al.
6,695,246 B1 2/2004 Elliott et al.
6,793,170 B2 9/2004 Denen et al.
6,838,887 B2 1/2005 Denen et al.
6,860,447 B2 * 3/2005 Boone et al. ..... 242/579
6,871,815 B2 3/2005 Moody et al.
7,017,856 B2 3/2006 Moody et al.
7,036,764 B2 * 5/2006 Granger et al. ..... 242/564.5
7,387,274 B2 6/2008 Moody et al.
2002/0030061 A1 3/2002 Formon
2002/0109034 A1 8/2002 Moody et al.
2002/0109035 A1 8/2002 Denen et al.
2002/0109036 A1 8/2002 Denen et al.
2003/0197086 A1 10/2003 Denen et al.
2004/0135027 A1 7/2004 Elliott et al.
2004/0160234 A1 8/2004 Denen et al.
2004/0178297 A1 9/2004 Moody et al.
2005/0072874 A1 4/2005 Denen et al.
2005/0127232 A1 6/2005 Moody et al.

FOREIGN PATENT DOCUMENTS

DE 20108336 U1 8/2001
EP 0459050 B1 8/1993
EP 0994667 B1 4/2003
FR 2539293 A1 7/1984
FR 2583729 A1 12/1986
FR 2771620 A1 6/1999
GB 2058014 A 4/1981
GB 2267271 A 12/1993
JP 63295344 A 12/1988

OTHER PUBLICATIONS

International Search Report and Written Opinion of the International Searching Authority that issued Jun. 4, 2008 in connection with PCT/US2007/081381.
English Abstract for EP0459050B1; Publication Date: Aug. 25, 1993; One page.
English Translation of the Abstract for DE20108336; Publication Date: Aug. 2, 2001; One page.

English Abstract for FR2771620A1; Publication Date: Jun. 4, 1999; One page.
English Abstract for FR2539293B1; Publication Date: May 17, 1985; One page.
Opposition filed by ILLE Papier-Service GmbH on Apr. 30, 2007, against European Patent No. 1231823, Application No. 02250924.4, 11 pages.
English Translation of the Opposition filed by ILLE Papier-Service on Apr. 30, 2007, against European Patent No. 1231823, Application No. 02250924.4, 8 pages.
Extended European Search Report for Application No. 06118266.3; Date of Mailing: Jul. 17, 2008; 5 pages.

* cited by examiner

DISPENSER HOUSING WITH MOTORIZED ROLLER TRANSPORT

BACKGROUND

This invention relates generally to a method and apparatus for dispensing individual sheets from a continuous web of material, and more particularly for a dispenser housing with a motorized roller transport mechanism for loading and dispensing the material.

Known electrically powered dispensers for paper towels and the like typically include a drive roller and an associated pinch roller formed on conductive metal shafts which are supported by a molded plastic chassis, with the pinch roller being spring biased into the drive roller. Other known dispensers support the shaft ends on separate metal plates that are attached to a common housing, and typically include a separate low friction bearing material between the metal plates and the metal shafts. The known electrically powered dispensers may also be provided with a separate special purpose grounding connection between the pinch roller shaft and an external ground terminal and with motorized roller transport mechanisms utilizing a proximity detector for dispensing single sheets from a continuous web. See for example commonly assigned Moody et al U.S. Pat. No. 6,871,815 entitled Static Build Up Control in Electronic Dispensing Systems and Denen et al U.S. Pat. No. 6,838,887 entitled Proximity detection circuit and method of detecting small capacitance changes, which are both incorporated by reference in their entirety.

SUMMARY

The present invention represents an improvement over known electrically powered dispensers for paper towels or the like.

According to one aspect of the invention, a special roller bracket provides not only proper positioning of the drive and pinch roller shafts, but also tension and grounding between the drive and pinch rollers, thereby producing a dispenser that is potentially both reliable to operate and simple to assemble. the roller bracket includes a first side plate for supporting a first respective end of each of the two shafts, a second side plate for supporting a second respective end of each of the two shafts. and a mounting bar attached between the two side plates, and is integrally formed from a single sheet of conductive material. Preferably the mounting bar includes an integrally formed tear bar portion for cutting the material after it has been transported past the rollers.

In one embodiment, each side plate portion of the roller bracket includes a stationary bearing portion supporting the drive roller shaft and a moveable bearing portion supporting the pinch roller shaft, with a flexible bridge (or arm) portion connecting the stationary bearing portion to the moveable bearing portion and having a major surface parallel to the two longitudinal axes such that the pinch roller shaft is free to move laterally with respect to the drive roller shaft. Since the stationary and moveable bearing portions are integrally formed from the same sheet of conductive material, a conductive path exists from the mounting bar to each of the bearing portions. Moreover, since the flexible bridge portion is in tension when the two shafts are supported by the two side plates with the drive roller in contact with the pinch roller, each of the two conductive shafts is biased against a respective conductive bearing portion to thereby complete a static discharge path from the rollers to the mounting bar without requiring any separate springs, contacts or wires. The mounting bracket may function as a grounding terminal, or may be connected to a separate grounding terminal. In either case, a simple and reliable static electricity discharge path is provided from each of the rollers to the grounding terminal through the respective shafts and bearing surfaces.

According to another aspect of the invention, a mounting bracket including a pair of side plates separated by a connecting tear bar is formed from a single sheet of conductive material and includes a pair of fixed bearing surfaces for supporting a drive roller shaft and a pair of flexible spring arms each terminated by a moveable bearing surface for supporting a pinch roller shaft, the spring arms being formed and positioned to provide a tension force for urging the pinch roller into contact with the drive roller. The tear bar is attached to a housing and the drive roller assembly is installed into a separate chassis with the drive roller shaft inserted into a pair of chassis end plates and with a gear train coupling the drive roller shaft to a motor mounted on the chassis. The chassis assembly is then inserted into the housing between the side plates of the mounting bracket such that the drive roller shaft is free to make ohmic contact with the fixed bearing surfaces and the chassis assembly is securely attached to the housing and to the mounting bracket. The spring arms are then temporarily displaced away from the chassis assembly and the pinch roller assembly is inserted into the end plates, with moveable bearing surfaces aligned with the respective ends of the pinch roller shaft such that the tension force is applied between the pinch roller and the drive roller.

In a preferred embodiment, a respective slot in each chassis end plate constrains the drive roller shaft of the assembled transport mechanism in one lateral direction and the adjacent fixed bearing surface cooperates with the tension force from the spring arms to constrain the drive roller shaft in a second lateral direction.

Other novel aspects of the invention, including but not limited to those set forth in the appended claims, will be apparent to those skilled in the art from the referenced Drawings and from the various described Embodiment(s). In particular, the housing of a described Preferred Embodiment of a paper towel dispenser includes not only a roller-based transport mechanism, but also a door mounted projection blade for assisting paper loading, a removable top cover that also functions as a universal mounting bracket, and flexible paper protection fingers that discourage unwanted contact between the paper and the tear bar.

DRAWINGS

Figure 3:
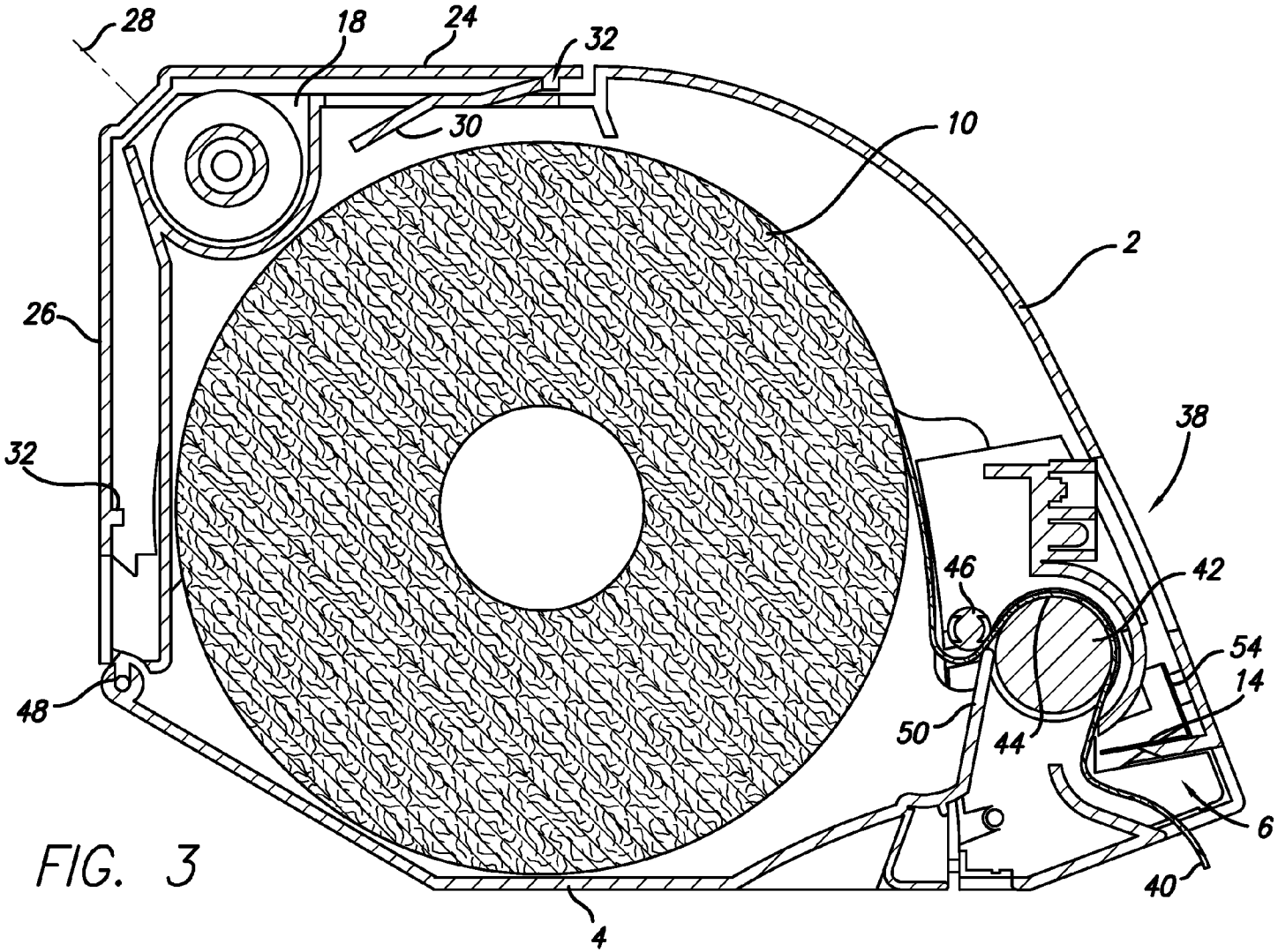
FIG. 3 is a cross sectional schematic view through an exemplary roller based transport mechanism, showing how web-like material such as paper may be transported from a supply roll around a drive roller, past a tear bar, and out through a discharge opening of a housing.
Figure 4:
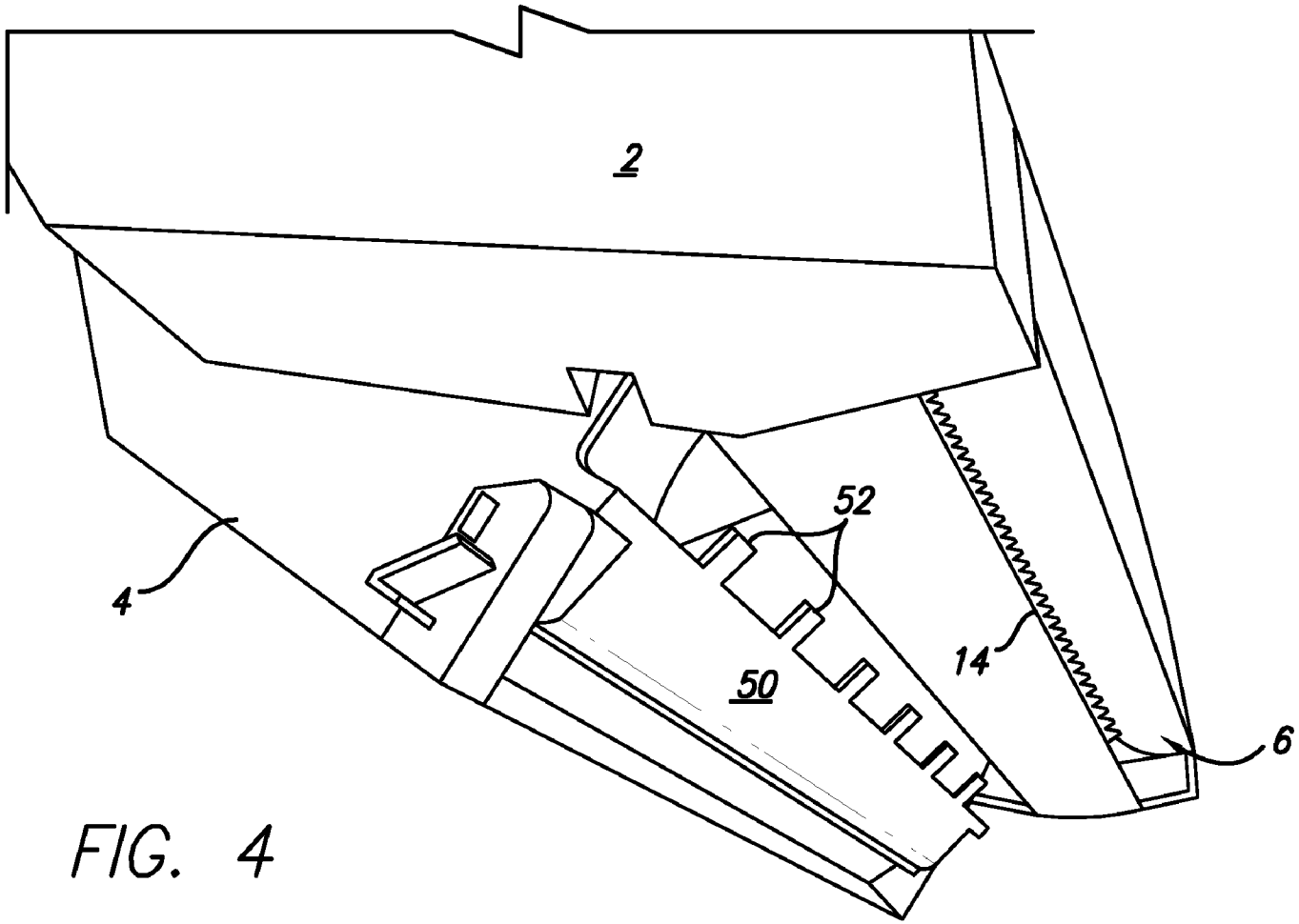
FIG. 4 shows an exemplary insertion blade with several projecting teeth formed on the hinged door of FIG. 3, which assist in the paper loading process.
Figure 13:
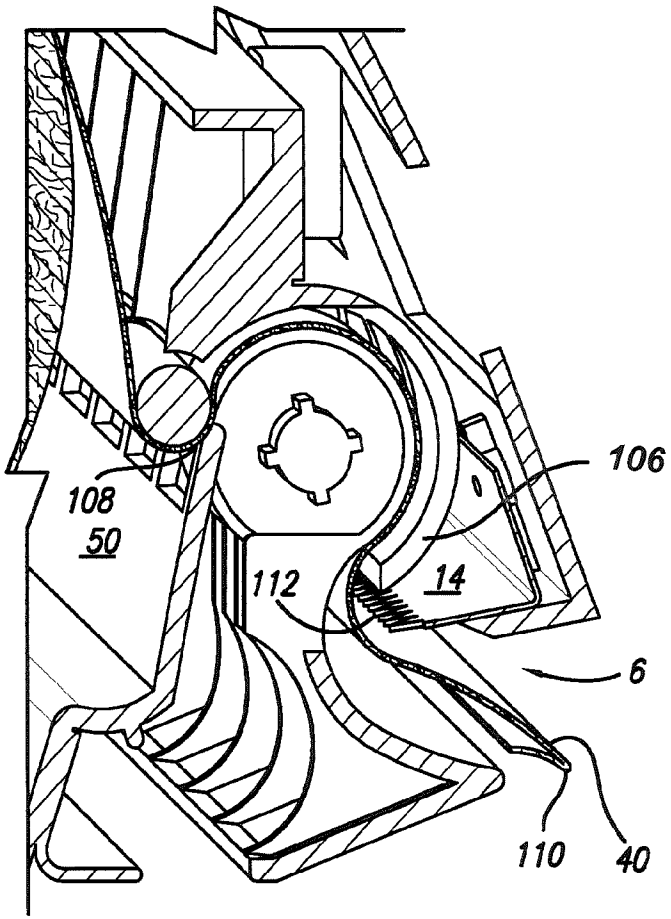
Figure 12:
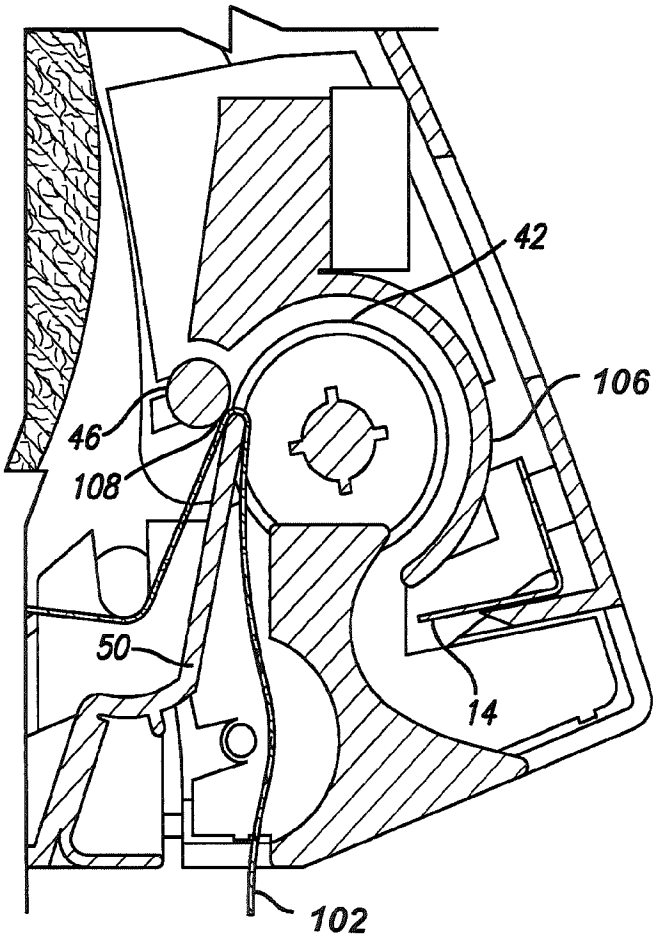

FIG. 12 shows how the teeth on the insertion blade of FIG. 4 guide the exposed folded edge of the paper roll into the nip between the drive roller and the pinch roller, FIG. 13 shows how the folded edge of FIG. 12 may then be transported by the rollers and guided by the guide fingers towards and through the discharge opening of FIG. 3 such that the guide fingers are deflected when the user pulls on the exposed paper, thereby permitting the paper to be penetrated by the adjacent cutting teeth of the tear bar.

PREFERRED EMBODIMENT(S)

Figure 1:
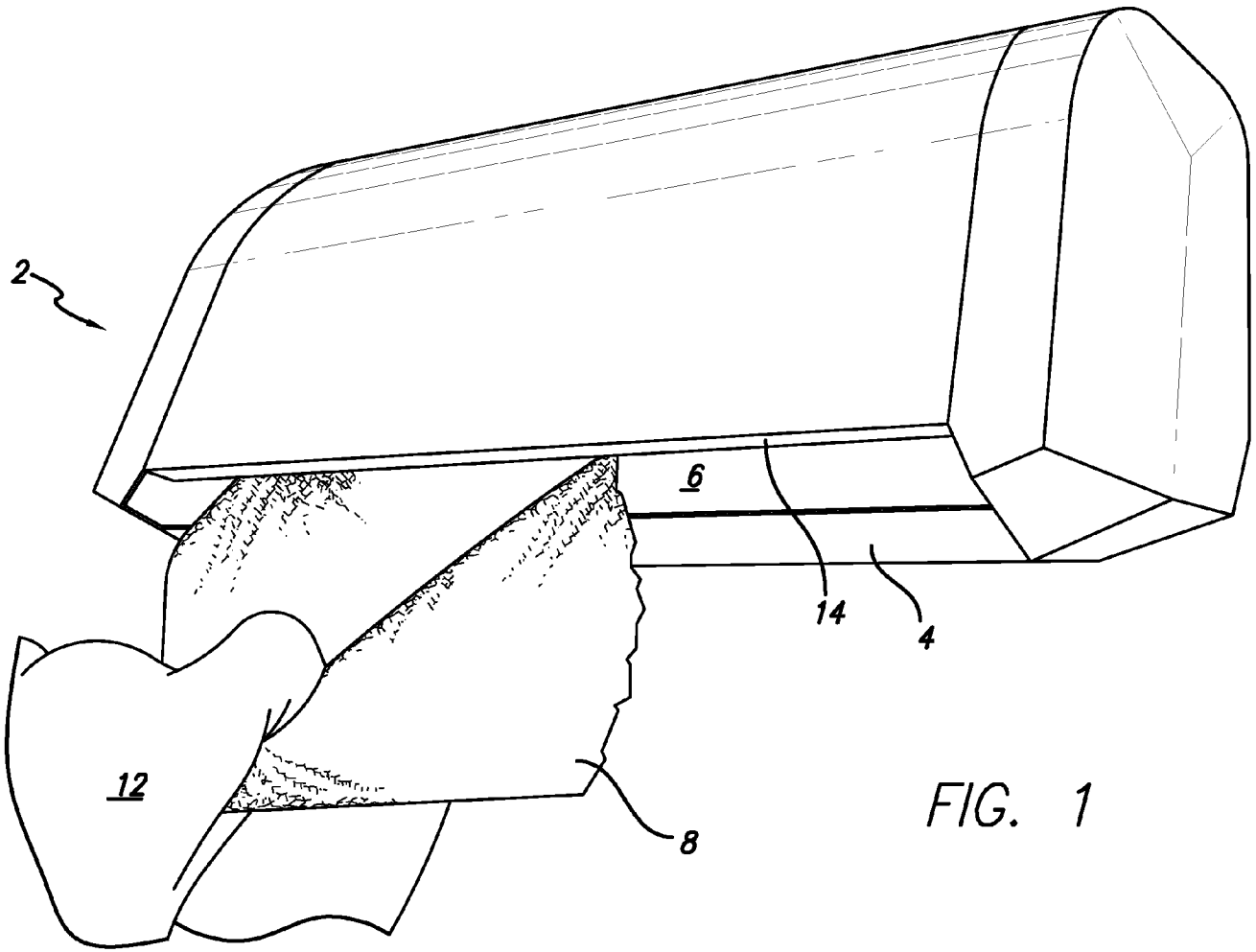
FIG. 1 is a perspective view of one embodiment of an exemplary dispenser housing in use.

FIG. 1 is a perspective view of one embodiment of an exemplary dispenser housing 2 in use. In particular housing is provided with a rearwardly hinged lower door 4 and a discharge front opening 6 through which a predetermined length 8 from a roll 10 of paper toweling (FIG. 3) is dispensed, waiting to be torn off by the hand 12 of a user against the cutting teeth of a concealed tear bar 14 (see also FIG. 5).

Figure 2:
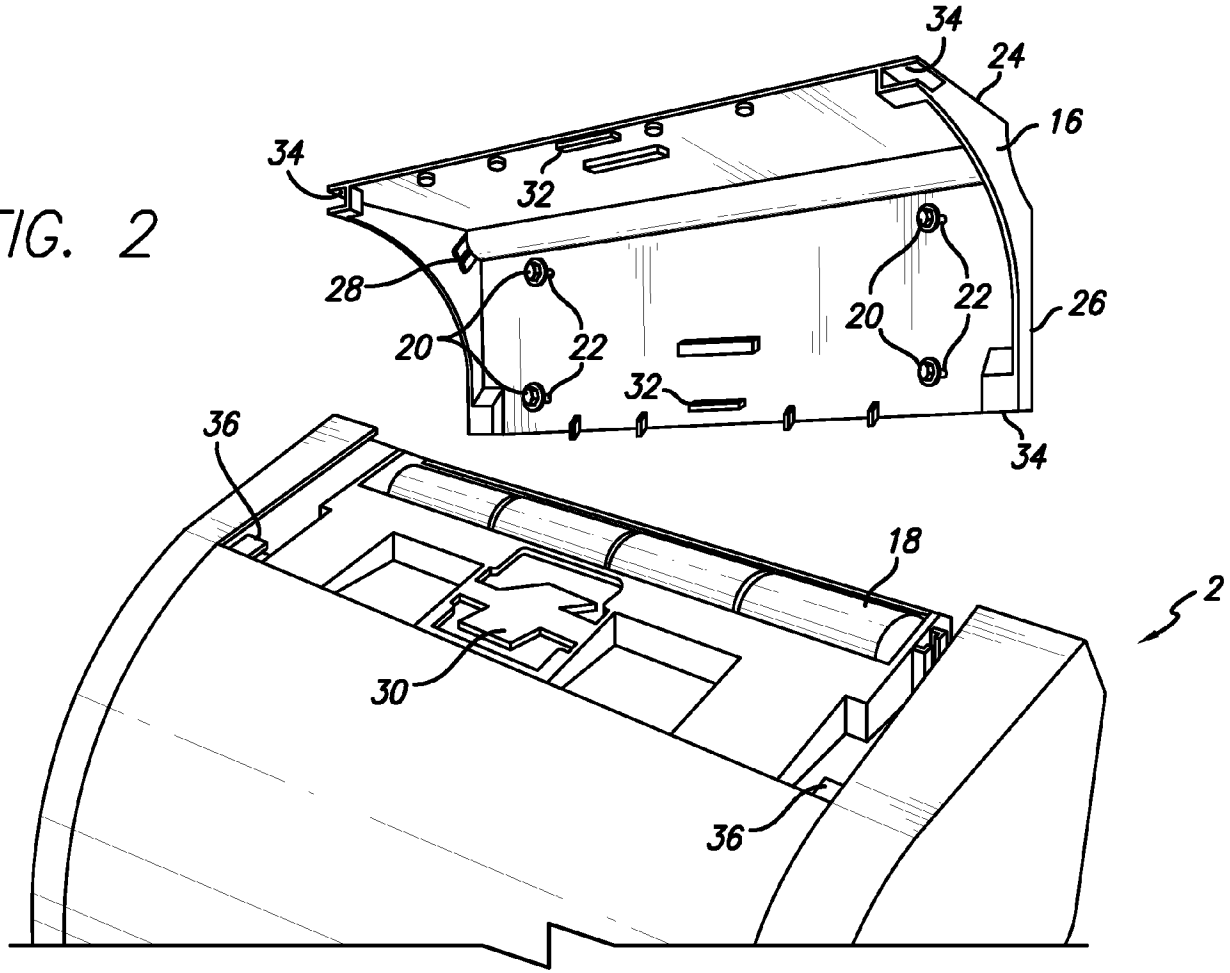
FIG. 2 shows how a symmetric cover over the upper rear portion of the housing of FIG. 1 may function as a universal mounting bracket for attaching the housing either to a vertical or to a horizontal surface.

FIG. 2 shows how a removable cover 16 over a battery compartment 18 provided in the upper rear portion of the housing 2 of FIG. 1 may function as a universal mounting bracket for attaching the housing 2 either to a vertical or to a horizontal surface by means of four mounting screws 20. It will be noted that except for the four holes 22, the upper 24 and rear 26 surfaces of cover 16 are mirror images of each other and are symmetrically disposed about a 45 degree axis 28, with upper surface 24 being disposed at an angle which is 90° from rear surface 26, whereby cover 16 may be installed on housing 2 with screw holes 22 exposed upwardly (to facilitate horizontal mounting under a cabinet or rearwardly (to facilitate mounting on a vertical wall. Also visible in FIG. 2 is a latch 30 which is biased forwardly and upwardly towards a corresponding one of a pair of stop ribs 32 projecting from the underside of cover 16, as well as a slot 34 on each corner of cover 16, such that the two slots 34 which are at the upper front corners of the attached cover 16 are mated with two corresponding rearwardly facing tabs 36 in at the top of housing 2. To mount the dispenser, cover 16 is first screwed or otherwise attached to a support surface, and then the housing 2 is slid rearwardly into engagement with cover 16 with the two rearwardly facing tabs 36 inserted in the two forwardly facing slots 34, until forwardly facing latch 30 has slid past and engaged the rear surface of the upper stop rib 32.

Reference should now be made to FIG. 3, which is a cross sectional schematic view through an exemplary roller based transport mechanism 38, showing how a elongated web 40 of absorbent paper toweling or other flexible material may be transported from supply roll 10, around a drive roller 42, past tear bar 14, and out through discharge opening 6 of housing 2. In the illustrated embodiment, drive roller 42 is sectioned which not only saves on material and reduces any need for a perfectly round roller, but also reduces static generation.

In particular, it should be noted that the paper material 40 is advanced from supply roll 10 to discharge opening 6 by virtue of being kept in intimate contact with the outer periphery 44 of drive roller 42 by means of a pinch roller 46, at a speed corresponding to the surface velocity of drive roller 42. Exemplary performance specifications for paper towel stock weighing 18 to 60 pounds per ream and supplied in a roll form with a nominal diameter of 3 to 6 inches would be 25 to 30 feet per minute. Also visible in FIG. 3 is the battery compartment 18 and a hinge 48 which permits door 4 to drop down for loading a replacement roll 10 of paper toweling.

FIG. 4 shows an exemplary insertion blade 50 (shown in cross section in FIG. 3) with several projecting teeth 52 formed on the hinged door 4 which cooperate with the drive roller 42 and the pinch roller 46 to assist in the paper loading process, as will be described in more detail hereinafter with respect to FIG. 12.

Figure 5:
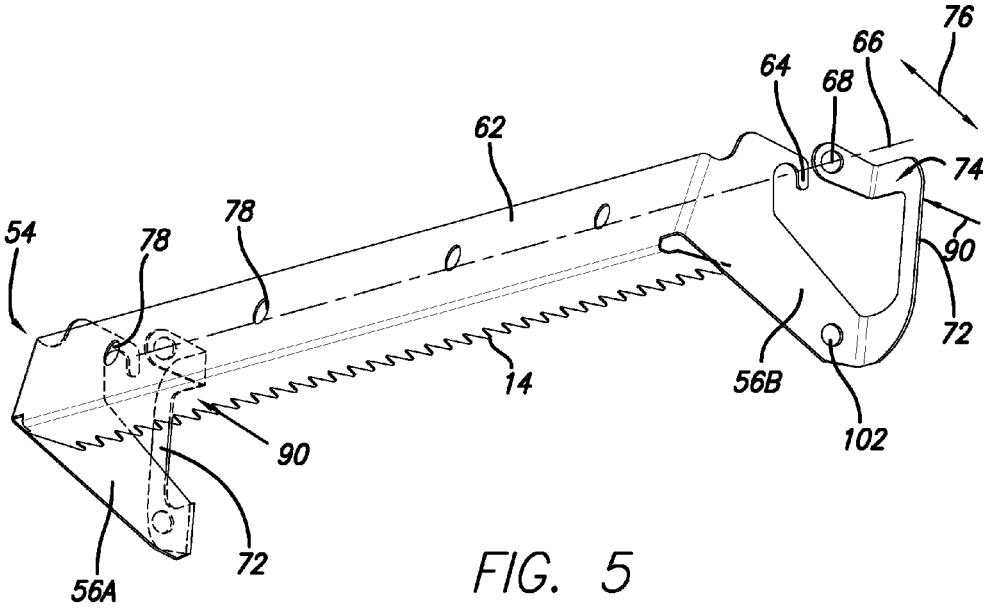
FIG. 5 is an isometric view of one embodiment of a unitary transport roller bracket.

FIG. 5 is an isometric view of an exemplary unitary mounting bracket 54 suitable for use with one preferred embodiment of the present invention. As will become more apparent from the subsequent discussion of FIG. 6 mounting bracket 54 includes a first side plate 56A for supporting a first respective end of each of two shafts 58,60 (see FIG. 6). a second side plate 56B for supporting a second respective end of each of the two shafts 58,60, and a mounting bar 62 attached between the two side plates 56A,56B, and is integrally formed from a single sheet of conductive material such as 304 Stainless Spring Steel of 24 gauge (0.0239"). No heat treatment would be required and it could be made from rolled steel. Preferably the mounting bar 62 includes integrally formed (die stamped and then appropriately bent) tear bar portion 14 which as mentioned previously, is used for cutting a predetermined length of material after it has been transported past the rollers 42,46

Each side plate portion 56A,56B of the mounting bracket 54 includes a stationary bearing portion 64 for supporting the drive roller shaft about a longitudinal drive roller axis 66 (see also FIG. 6) and a moveable bearing portion 68 for supporting the pinch roller shaft about a longitudinal pinch roller axis 70. As shown stationary bearing portion 64 is in the shape of a half loop, to facilitate assembly, with the loop preferably being closed by a slotted plastic end wall of a separate chassis (see FIG. 8) which provides an additional bearing surface that opposes any pulling on the material as it exits the dispenser. A flexible bridge (or arm) portion 72 connects the stationary bearing portion 64 to the moveable bearing portion 68. A major surface 74 of each arm 72 is parallel to the two longitudinal axes 66,70 such that pinch roller shaft 60 is free to move laterally (arrow 76) with respect to the drive roller shaft 58, spring arms 72 being formed and positioned to provide the required tension force (on the order of 3 pounds) for urging the pinch roller 46 toward the drive roller 42 so as to prevent any undesired slippage between material 40 and drive surface 44.

Figure 6:
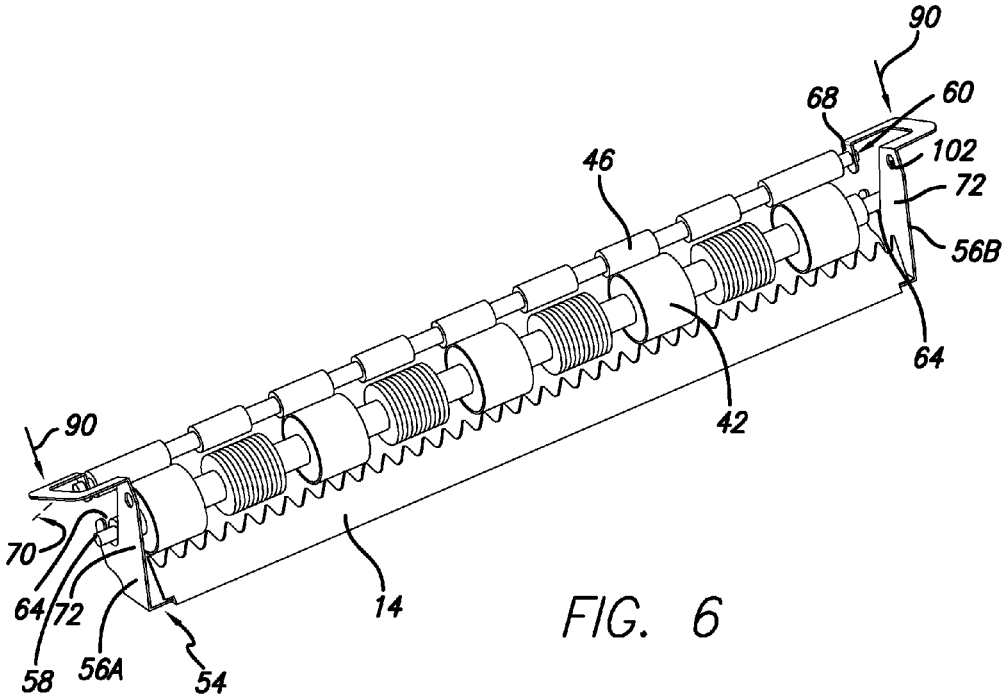
FIG. 6 shows how the drive roller and pinch roller of an exemplary transport mechanism may be supported by the roller bracket of FIG. 5.

Since the stationary and moveable bearing portions 64,68 are integrally formed from the same sheet of conductive material, a conductive path exists from the mounting bar 62 to each of the bearing portions 64,68. Moreover, as best seen in FIG. 6, since the flexible bridge portion 72 is in tension when the two shafts 58,60 are supported by the two side plates 56A,56B with the drive roller 42 in contact with the pinch roller 46, drive roller shaft 58 is thrust against a stationary bearing portion 64, and pinch roller shaft 60 is thrust against a moveable bearing portion 68, to thereby complete a static discharge path from rollers 42,46 to the mounting bar 62 without requiring any separate springs, contacts, rolling shafts or wires. The mounting bracket 54 may function as a grounding terminal, or may be connected to a separate grounding terminal (not shown). In either case, a simple and reliable static electricity discharge path is provided from each of the rollers 42,46 to the grounding terminal through the respective shafts 58,60 and bearing surfaces 64,68.

A preferred method of assembly will now be described with specific reference to FIG. 7, FIG. 8, and FIG. 9.

Figure 7:
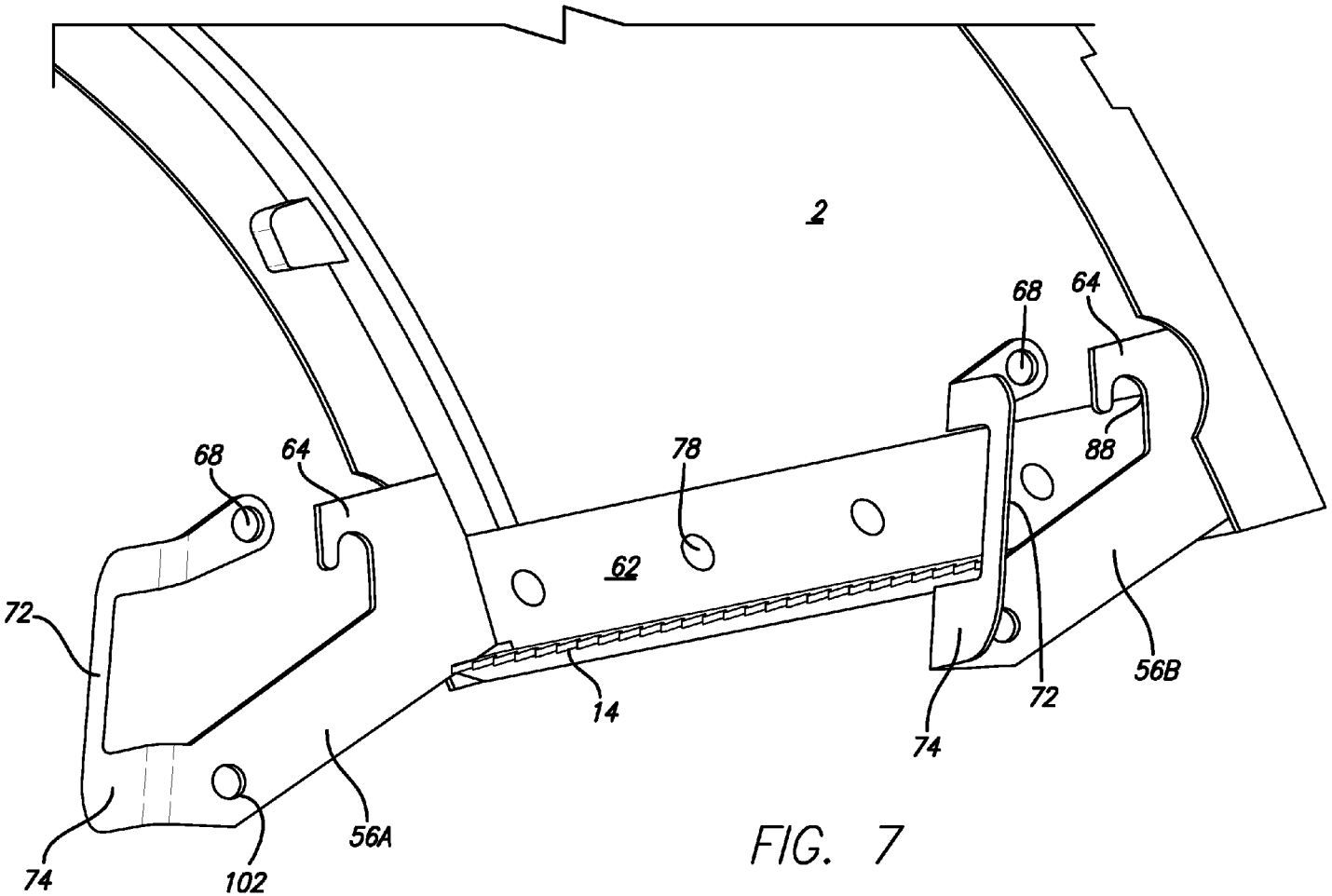
FIG. 7 shows how the roller bracket of FIG. 5 may be secured to the interior of the housing of FIG. 1.

First, as shown in FIG. 7, tear bar 14 is heat staked to housing 2 using a series of pegs molded into housing 2 that protrude though respective holes 78 (FIG. 5) in mounting bar 62. Concurrently, as shown FIG. 8, drive roller assembly 42 is installed into a separate chassis 80 with the two ends of drive roller shaft 58 inserted into respective slots 82 provided in chassis end plates 84A,84B.

Figure 8:
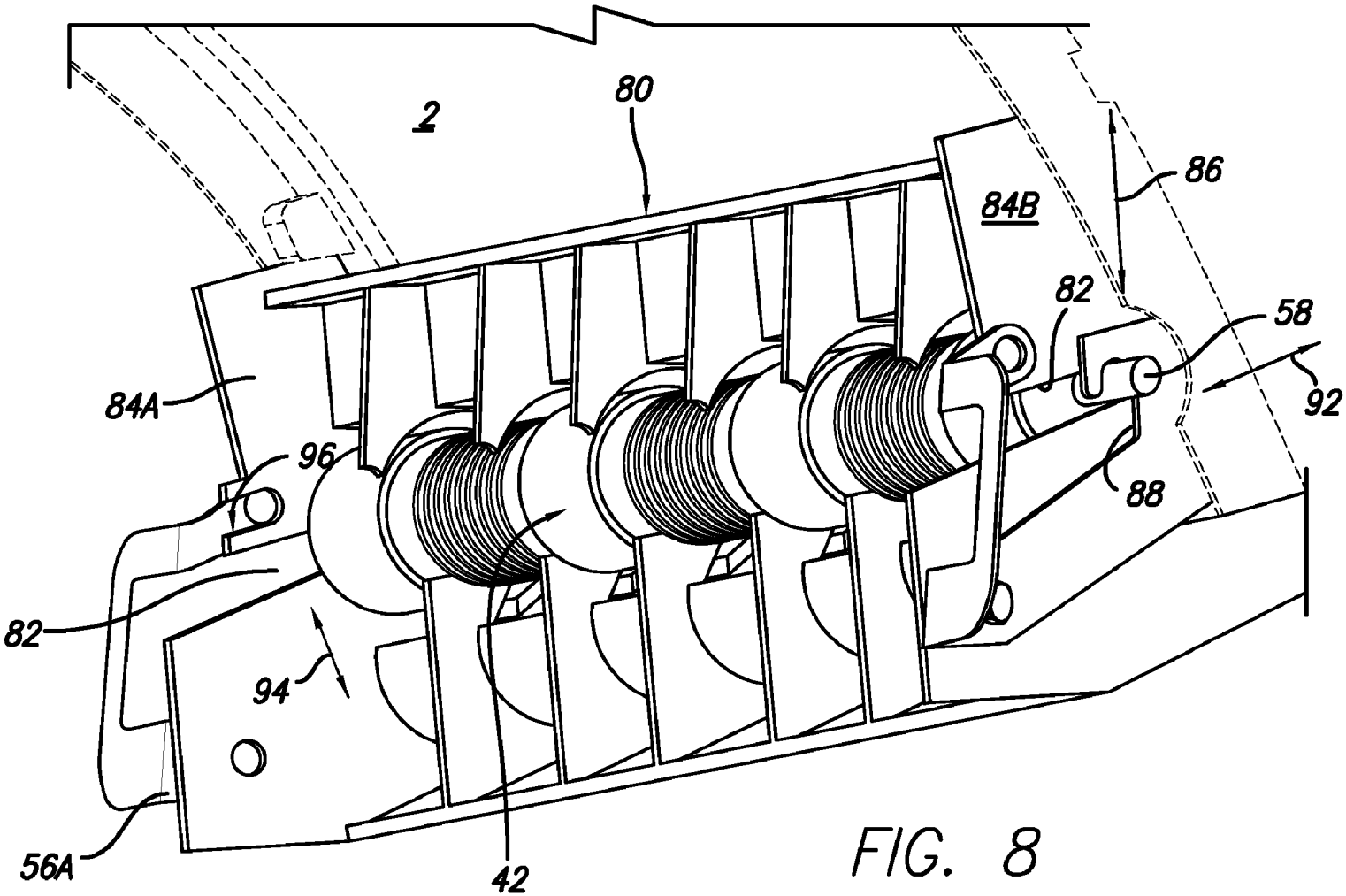
FIG. 8 shows how the drive roller of FIG. 6 may be installed into an exemplary chassis and the chassis may then be positioned between the two side plates of the secured roller bracket of FIG. 7, with a slot in the chassis cooperating with an intersecting bearing surface of the roller bracket of FIG. 5 to constrain the drive roller shaft of FIG. 6.

Next, as best seen in FIG. 8, the assembled chassis including the drive roller assembly 42 is slid between the two side plates 56A,56B of previously installed mounting bracket 54, and pushed upwardly into the housing 2 until it is properly positioned against appropriately located tabs and slots. Preferably, slots 82 in chassis end plates 84A,84B constrains the drive roller shaft 58 of the assembled transport mechanism in one lateral direction 86 (FIG. 8) and the adjacent fixed bearing surface 88 of the adjacent stationary bearing portion 64 of side plate 56 cooperates with the tension force 90 (FIG. 5) from the adjacent spring arm 72 (FIG. 5) to constrain the drive roller shaft 58 in a second lateral direction 76 (FIG. 5).

Figure 9:
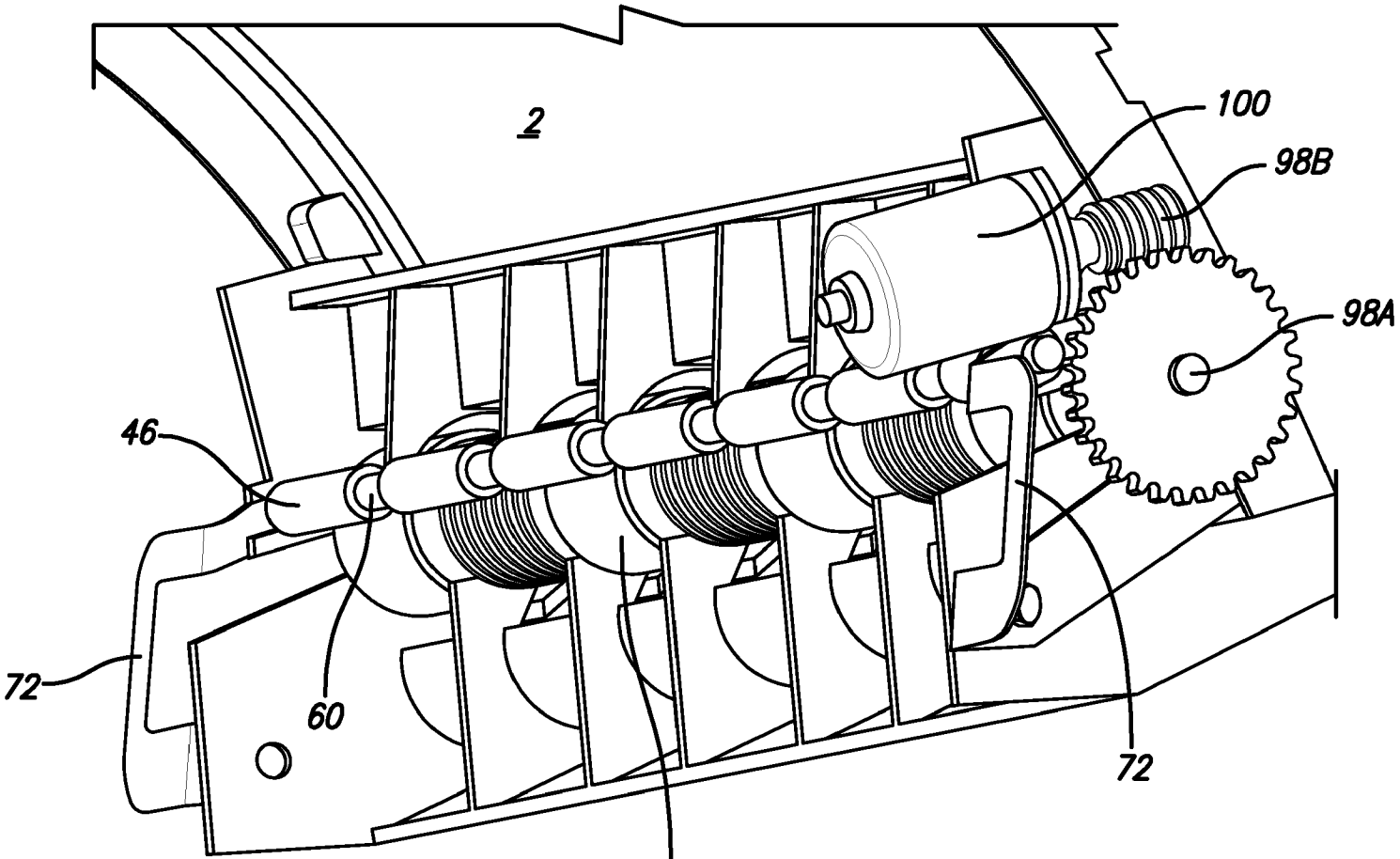
FIG. 9 shows how an exemplary motor and gear train may be installed on the chassis assembly of FIG. 8 after the chassis assembly has already been already installed in the housing.

As shown in FIG. 9, spring arms 72 are temporarily displaced sideways to permit pinch roller assembly 46 to be inserted between the two arms 72, which are then released with the two ends of pinch roller shaft 60 inserted into corresponding bearing portions 68 such that tension from the spring arms 72 forces the pinch roller 46 into engagement with drive roller 42, in a direction constrained by a slot 98 in end plates 84.

To complete the assembly of chassis 80, a worm gear 86A is attached to one end of drive roller shaft 74 to thereby couple shaft 74 to a previously mounted motor and pinion assembly 88,86B, and the chassis 80 may be more rigidly secured in its operative position relative to bracket 54 by means of self tapping screws (not shown) through appropriately positioned clearance holes 90 in the side plates 56A,56B into corresponding pilot holes (not shown) in the chassis 80.

Figure 11:
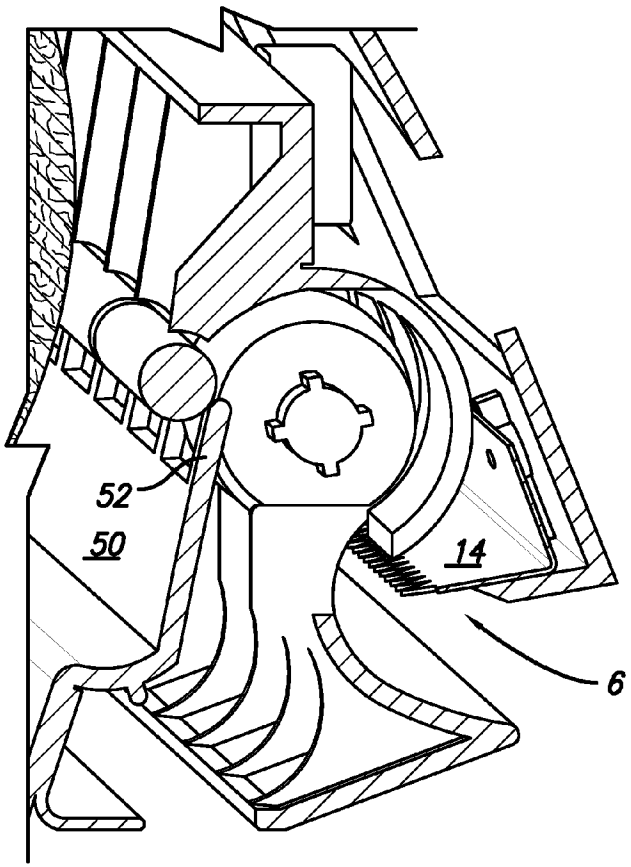
FIG. 11 shows how the embodiment of FIG. 3 contains flexible curved guide fingers lacking in the embodiment of FIG. 10.
Figure 10:
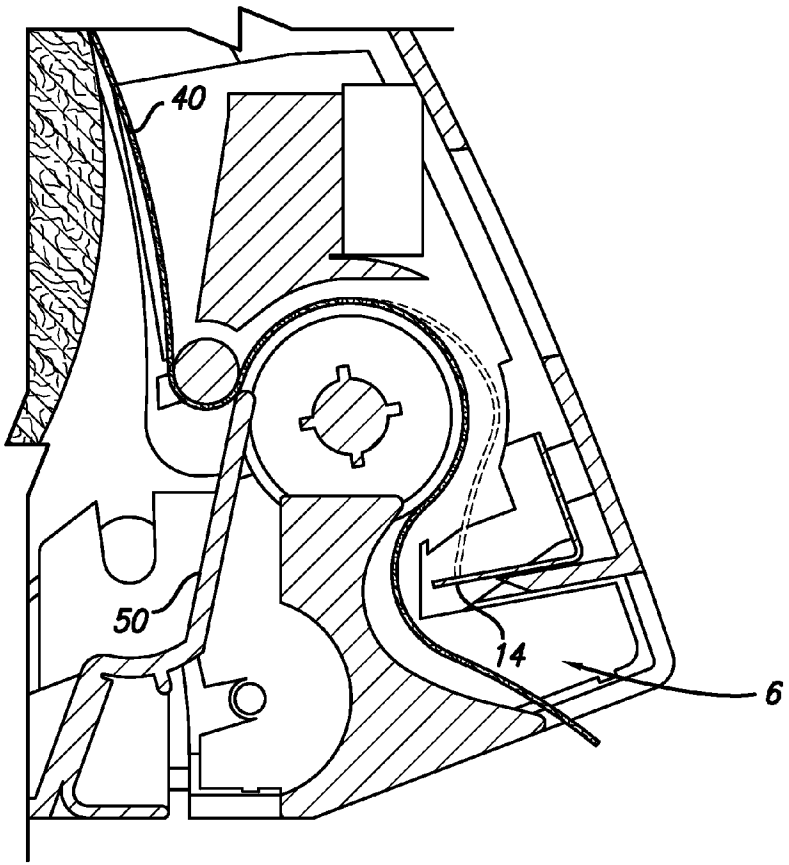
FIG. 10 illustrates an inferior alternative to the embodiment of FIG. 3 with undesirable interference between a cut end of the paper and the tear bar.

Loading of paper will now be described with reference to FIG. 4, FIG. 12 and FIG. 11. A roll 10 of paper is first loaded above door 4 (in different embodiments, it may be supported by the upper surface of door 4 or by conventional hubs and/or shafts (not shown) attached to door 4 or to the stationary interior of housing 2), and with its exposed end 110 draped over teeth 52 or insertion blade 50 framed in the still open door 4. When the door is closed (FIG. 12) insertion blade teeth 52 forces the now folded leading edge 102 into nip 108 between drive roller 42 and pinch roller 46. The motor 100 is now activated for a predetermined period of time (for example, about 3 seconds), either by means of a manual switch, or preferably by means of a timing circuit in response to automatic detection of the closing of the door 4 and the accompanying insertion of the folded paper edge 102 into nip 108. Alternatively, the motor activation can be limited to a predetermined number of rotations and/or until the folded edge 102 has been detected at a predetermined location in the vicinity of discharge opening 6.

As the paper 40 is transported from nip 108 to discharge opening 6, it is guided by a plurality of springy semicircular guide fingers 106 which are normally oriented towards drive roller 42 such that the exiting end of paper 110 is protected from any contact with teeth 112 of tear bar 14. However, as best seen in FIG. 11, when the user pulls on the exposed paper, the resultant tension causes the guide fingers 106 to be displaced away from drive roller 42 and the paper 40 is forced into penetrating contact with the teeth 112 of tear bar 14. Thus each springy finger 106 normally keeps the paper 40 off the tear bar 14, but is still sufficiently flexible to allow the tensioned paper 40 to be cut by tear bar 14.

The invention claimed is:

1. For use with an electrically powered dispenser, a material transport mechanism comprising:

a drive roller formed about an electrically conductive drive roller shaft and extending longitudinally along a drive roller axis;

a pinch roller formed about an electrically conductive pinch roller shaft and extending longitudinally along a pinch roller axis parallel to the drive roller axis; and a unitary mounting bracket further comprising:

a first side plate for supporting a first respective end of each of the two shafts, a second side plate for supporting a second respective end of each of the two shafts, and a mounting bar attached between the two side plates;

wherein:

the unitary mounting bracket including both the two side plates and the mounting bar is integrally formed from a single sheet of electrically conductive material, the unitary mounting bracket providing a static electricity discharge path from each of the drive roller and the pinch roller through their respective shafts.

2. The transport mechanism of claim 1 wherein the two rollers cooperate to define a nip for accepting, transporting and dispensing a sheet of material when the drive roller shaft is rotated in a predetermined forward direction.

3. The transport mechanism of claim 2 wherein the mounting bar includes an integrally formed tear bar portion for cutting said material after it has been transported past said rollers.

4. The transport mechanism of claim 1 wherein each of the side plates further comprises:

a stationary bearing portion supporting the drive roller shaft, a moveable bearing portion supporting the pinch roller shaft, and a flexible bridge portion connecting the stationary bearing portion to the moveable bearing portion and having a major surface parallel to the two longitudinal axes whereby the pinch roller shaft is free to move laterally with respect to the drive roller shaft.

5. The transport mechanism of claim 4 wherein:

the stationary and moveable bearing portions are integrally formed from said single sheet of conductive material, thereby forming a conductive path from said mounting bar to each of said bearing portions.

6. The transport mechanism of claim 5 wherein:

the flexible bridge portion biases each of the two shafts against a respective bearing portion to thereby provide a static discharge path from said rollers to said mounting bar.

7. The transport mechanism of claim 6 wherein:

the flexible bridge portion is in tension when the two shafts are supported by the two side plates with the drive roller in contact with the pinch roller, the pinch roller shaft is biased against the moveable bearing portion by the tensioned bridge portion, and the drive roller shaft is biased against the stationary bearing portion by the tensioned bridge portion.

8. The transport mechanism of claim 1, further comprising:

a housing having an interior wall;

means for securing the mounting bar to said interior wall; and a chassis assembly adapted to be secured to said interior wall between said side plates, said chassis assembly including:

a plurality of ribs for guiding said material from a roll inside said housing into said nip between the two rollers, past said tear bar, and out of said housing;

a drive roller motor; and a gear train for coupling the motor to the drive roller shaft.

9. The transport mechanism of claim 8, wherein said chassis assembly further includes at least one end plate for supporting said drive roller shaft whereby the drive roller shaft may be attached to the gear train before the chassis assembly is secured to the interior wall.

10. The transport mechanism of claim 9, wherein the stationary bearing surface in each said side plate is in the shape of an open loop which is intersected by a corresponding drive roller shaft slot in each said end plate to constrain the drive roller shaft in more than one direction.

11. The transport mechanism of claim 9, wherein the moveable bearing surface in each said side plate is in the shape of an closed circle which is intersected by a corresponding pinch roller shaft slot in a respective said end plate to constrain any lateral motion of the pinch roller shaft to a direction defined by said pinch roller shaft slot.

12. A method for assembling a mechanism for transporting and cutting a web of material, comprising:

providing a drive roller and a pinch roller each having respective electrically conductive drive roller and pinch roller shafts;

forming an integral mounting bracket from a sheet of electrically conductive material, said bracket having a pair of side plate portions oriented in respective parallel planes separated by a connecting tear bar, each said side plate portion including a fixed bearing surface for supporting the drive roller shaft and a flexible spring arm terminated by a moveable bearing surface for supporting the pinch roller shaft, the spring arm being formed and positioned to provide a tension force for urging the pinch roller into contact with the drive roller, the mounting bracket providing a static electricity discharge path from each of the drive roller and the pinch roller through their respective shafts;

securing the tear bar to a housing;

providing a chassis with a pair of end plates for positioning the drive roller and pinch roller shafts and with a plurality of ribs for guiding said web from inside said housing, past said tear bar, and out of said housing;

forming a chassis assembly, further comprising:

installing the drive roller assembly into the chassis with the drive roller shaft inserted into the end plates, mounting a motor to the chassis, and coupling a gear train between the motor and the drive roller shaft;

inserting the chassis assembly into the housing between the side plates such that the drive roller shaft is free to make ohmic contact with the fixed bearing surfaces;

securing the chassis assembly to the housing and to the mounting bracket;

displacing the spring arms away from the chassis assembly and inserting the pinch roller assembly into the end plates; and aligning the moveable bearing surfaces with the respective ends of the pinch roller shaft such that said tension force is applied between the pinch roller and the drive roller.

13. The method of claim 12, wherein a respective slot in each end plate constrains the drive roller shaft of the assembled transport mechanism in one lateral direction and the adjacent fixed bearing surface constrains the drive roller shaft in a second lateral direction.

14. The method of claim 12, wherein the mounting bracket is connected to a grounding terminal, to thereby provide a static electricity discharge path from each of the rollers to the grounding terminal through the respective shafts and bearing surfaces.

15. The method of claim 12, wherein each said spring arm comprises a flexible bridge portion having a major surface parallel to the two shafts.

16. A dispenser for roll toweling comprising:

a housing having a storage cavity defined therein adapted for receiving a roll of toweling;

a discharge chute leading from said storage cavity to the exterior of said housing;

a drive roll, a nip roll and a drive motor, said motor being adapted to drive said drive roll, said drive roll and said nip roll being disposed adjacent to said discharge chute and adapted for advancing toweling through said discharge chute upon rotation of said drive roll by said motor;

a door hingedly mounted on said housing, movable by rotation between an open position and a closed position, said door having an insertion blade mounted thereupon;

said cavity, drive roll, nip roll, door, and insertion blade being arranged such that upon installing a roll of toweling in said storage cavity and draping of a free end of said toweling over said insertion blade, the free end of said toweling is inserted between said drive roll and said nip roll upon rotation of said door into said closed position.

17. The dispenser of claim 16 wherein said motor is activated upon closing of said door for a period of time sufficient to advance the free end of said toweling into said discharge chute.

18. A dispenser for roll toweling comprising:

a housing having a storage cavity defined therein adapted for receiving a roll of toweling;

a discharge chute leading from said storage cavity to the exterior of said housing, said discharge chute being adapted to receive toweling from said roll;

a drive roll, a nip roll and a drive motor, said motor being adapted to drive said drive roll, said drive roll and said nip roll being disposed adjacent to said discharge chute and adapted for advancing toweling through said discharge chute upon rotation of said drive roll by said motor;

a tear bar mounted adjacent said discharge chute;

at least one movable finger mounted adjacent said tear bar, between said tear bar and said storage cavity, said at least one movable finger being movable between a guard position and a retracted position, said movable finger being biased toward said guard position and movable into said retracted position upon imposition of tension upon toweling disposed within said discharge chute, movement of said movable finger into said guard position clearing residual toweling from said tear bar.

* * * * *